US005502283A

United States Patent [19]

Ukai et al.

[11] Patent Number: 5,502,283

[45] Date of Patent: Mar. 26, 1996

[54] MUFFLER

[75] Inventors: Hidehito Ukai; Kazuo Kometani; Kazuyuki Horie; Toshiaki Nakayama, all of Aichi, Japan

[73] Assignees: Toyoda Boshoku Kabushiki Kaisha; Nippondenso Co., Ltd., both of Japan

[21] Appl. No.: 400,200

[22] Filed: Mar. 3, 1995

Related U.S. Application Data

[63] Continuation of Ser. No. 950,251, Sep. 24, 1992, abandoned.

[30] Foreign Application Priority Data

Sep. 25, 1991 [JP] Japan ..... 3-245970
Jul. 31, 1992 [JP] Japan ..... 4-205459

[51] Int. Cl.[6] ..... F01N 7/08; F01N 1/02; F01N 1/08

[52] U.S. Cl. ..... 181/228; 181/250; 181/251; 181/266; 181/273; 181/276

[58] Field of Search ..... 181/227, 228, 181/250, 251, 266, 270, 273, 276, 282

[56] References Cited

U.S. PATENT DOCUMENTS

| | | | |
|---|---|---|---|
| 1,839,462 | 1/1932 | Bourne | 181/250 |
| 1,910,672 | 5/1933 | Bourne | 181/250 |
| 2,297,046 | 9/1942 | Bourne | 181/250 |
| 3,194,341 | 7/1965 | Haag | 181/228 |
| 3,396,812 | 8/1968 | Wilcox et al. | 181/250 |
| 3,402,785 | 9/1968 | Powers et al. | 181/250 |
| 3,415,338 | 12/1968 | McMillan | 181/250 |
| 3,655,011 | 4/1972 | Willett | 181/228 |
| 4,800,985 | 1/1989 | Hanzawa et al. | 181/250 X |

FOREIGN PATENT DOCUMENTS 62-126214 6/1987 Japan .

*Primary Examiner*—Cassandra C. Spyrou
*Attorney, Agent, or Firm*—Finnegan, Henderson, Farabow, Garrett & Dunner

[57] ABSTRACT

A muffler including an offshoot path, one end of which is connected to a middle of a ventilation path so as to diverge from the ventilation path, and another end of which is closed. One portion of the offshoot path and another portion thereof are communicated through a communicating portion. Accordingly, sound waves entering the offshoot path are propagated in a direction of a closed portion, and are also propagated via the communicating portion from the one portion to the other portion.

20 Claims, 9 Drawing Sheets

MUFFLER

This application is a continuation of application Ser. No. 07/950,251 filed Sep. 24, 1992, now abandoned.

BACKGROUND OF THE INVENTION

1. Field of the Invention

The present invention relates to a muffler which is located, for example, at the middle of an intake/exhaust ventilation path of an internal combustion engine and which damps intake/exhaust sounds.

2. Background of the Invention

Two types of mufflers, i.e., a side branch type muffler and a resonator type muffler, which will be described hereinafter, are commonly known.

Japanese Patent Application Laid-Open No. 62-126215 discloses the side branch type muffler, as shown in FIG. 14, in which a path body 62 is connected to the middle of an air path pipe 60. An offshoot path 64, whose base end is connected to the air path pipe 60 and whose other end is closed, is bent and formed within the path body 62.

In the conventional side branch type muffler, the frequency of sound waves to be damped (resonance frequency) is determined by the length of the offshoot path 64. In this type of muffler, even if low frequency sounds are to be deadened, a large volume is not needed for the entire muffler compared with the resonator type muffler. Therefore, the side branch type muffler is excellent in this respect. However, when sounds to be deadened are low frequency sounds, the offshoot path must be lengthened due to the muffler having a long, thin configuration. In this case in particular, it is difficult to suitably arrange the muffler within the engine compartment and ability to fit therein is inferior.

In the resonator type muffler, the frequency of sound waves to be damped (resonance frequency) is determined by the volume of a resonance chamber and by the sectional area and the length of a communicating pipe provided in the resonance chamber. With the resonator type muffler, not only can sound waves of the resonance frequency be damped, but sound waves of frequencies in the vicinity of the resonance frequency can be simultaneously damped as well. The resonator type muffler is excellent in this respect. However, there has been a drawback in that the volume of the resonance chamber of the muffler must be made relatively large. Especially when the resonance frequency is in a low frequency range, this drawback becomes marked. It is therefore not easy to install the muffler in a narrow engine compartment.

Because of the above-described circumstances, the special sound characteristics of the internal combustion engine whose sounds are to be deadened and the limitations of the space of the engine room are taken into consideration when selecting an appropriate type of muffler to be mounted to an internal combustion engine. The selection of the muffler is effected on a case-by-case basis.

However, usually sounds generated by an internal combustion engine vary in accordance with the engine speed and encompass a wide range of frequencies. Therefore, simply damping the sounds of only a certain frequency cannot sufficiently deaden the sounds which are generated by the internal combustion engine and which span a wide range of frequencies. This in turn may lead to dissatisfaction with the results of the sound deadening.

Accordingly, in this type of case, a plurality of mufflers, which correspond to the frequencies of sounds for which damping is desired, is connected to the communicating pipe at separate areas so that the sound deadening capacity improves.

However, a large mounting space is necessary to mount a plurality of mufflers. Therefore, it is difficult actually mount mufflers which correspond to sounds of all of the frequencies for which damping is desired.

SUMMARY OF THE INVENTION

With the aforementioned in view, an object of the present invention is to provide a muffler which, by having both the capability of a side branch type muffler and the capability of a resonator type muffler, sufficiently damps sounds covering a wide range of frequencies and requires a small mounting space.

A first aspect of the present invention is a muffler comprising an offshoot path means, one end of which is connected to a middle of a ventilation path, and another end of which is closed, and a communicating portion which communicates between one portion of the offshoot path means and another portion of the offshoot path means.

The muffler of the present invention may be structured so that the offshoot path means includes a first section including the one end and a second section including the other end and communicating with the first section. The second section is formed and bent by an outer shell and a partition wall partitioning an interior of a chamber formed by the outer shell.

By forming cutout portion(s), or opening(s), constituting the communicating portion, in the partition wall, sound waves entering the offshoot path within the chamber are propagated along the direction of the offshoot path to the closed end thereof. At the positions of the cutout portions, the sound waves escape in a direction orthogonal to the offshoot path direction, and short cuts are generated. The sound waves spread throughout the entire interior of the chamber, and the offshoot path is incomplete due to the cutout portions.

Due to this structure, not only is the function of a side branch type muffler exhibited, but the function of a resonator type muffler is also exhibited as the base end portion of the offshoot path is a communicating portion for a resonator and the entire interior of the chamber is a resonance chamber for a resonator.

Accordingly, in just the volume occupied by the offshoot path for a side branch, both the capacity of a side branch type muffler and the capacity of a resonator type muffler are combined. Damping of sounds of a plurality of frequency ranges is possible, and a narrow mounting space suffices.

A second aspect of the present invention is a muffler comprising a first offshoot path means, one end of which is connected to a middle of a ventilation path, and a second offshoot path means, one end of which is connected to another end of the first offshoot path means and another end of which is closed, wherein a sectional area of the second offshoot path means is greater than a sectional area of the first offshoot path means.

Further, by making the sectional area of the second offshoot path means larger than the sectional area of the first offshoot path means, the sound waves entering the second offshoot path means are propagated along the direction of the second offshoot path means to the closed end portion. At the second offshoot path means, the sound waves spread in a direction orthogonal to the direction of the second offshoot path means. Not only is the function of a side branch muffler exhibited, but also the function of a resonator type muffler is exhibited as the base portion of the first offshoot path means is a communicating portion for a resonator and the second offshoot path means is a resonance chamber for a resonator.

In the muffler of the present invention, the capacity of a side branch type muffler and the capacity of a resonator type muffler are combined. Further, the volume of the entire apparatus is only increased by the amount by which the sectional area of the second offshoot path means is made larger than the sectional area of the first offshoot path means. This increase in volume is extremely small compared with a case in which a side branch type muffler and a resonator type muffler are provided separately.

In the first aspect of the present invention, the offshoot path means can be formed so that the communicating portion is provided by providing an opening in the partition wall.

Further, the offshoot path means can be formed by a joining of two members having configurations which, together with the partition wall, are divided in a direction along a longitudinal direction of the offshoot path means so as to have two partition wall portions constituting a full partition wall.

Moreover, the offshoot path means is formed of two members which confront each other and which have respective confronting edges which run along the direction of the offshoot path for a side branch to the end thereof. The cutout portions are formed as slit holes and are provided in at least one of the members, i.e., at least one of the partition walls. Ones of ends of the slit holes are open at the confronting edge of the member, and the other ends thereof are closed. The proportion of the area which the open end of the slit hole occupies with respect to the entire area of the slit hole is small. Therefore, excessive dimensional accuracy of the dimension of the member in the confronting direction is not required in the production of the members or in the opposing of the members during assembly thereof. As a result, the production of the muffler is facilitated. In addition, the predetermined dimensional configuration of the slit hole is easily obtained, and the precision of the areas of the openings of the cutout portions improves.

Accordingly, the ratio of the areas of the openings of the cutout portions with respect to the sectional area of the offshoot path for a side branch within the chamber is obtained with high precision. Therefore, tuning with respect to the frequencies of sound for which damping is desired can be effected easily and precisely.

DESCRIPTION OF THE PREFERRED EMBODIMENTS

Figure 1:
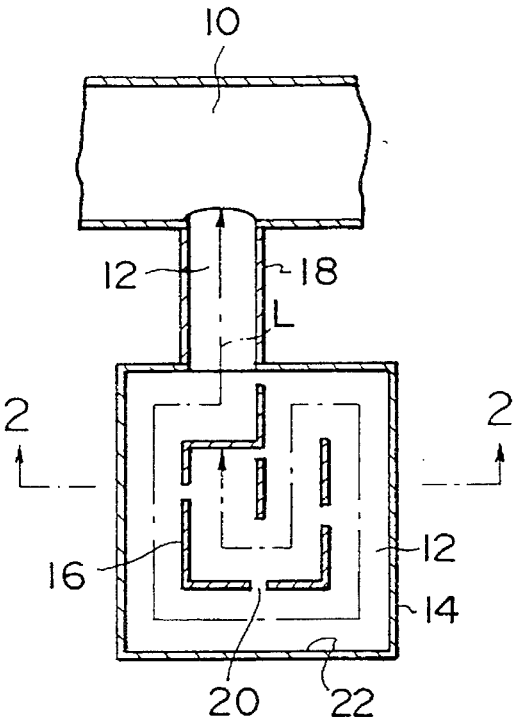
FIG. 1 is a vertical sectional view of a first embodiment relating to a muffler of the present invention.
Figure 2:
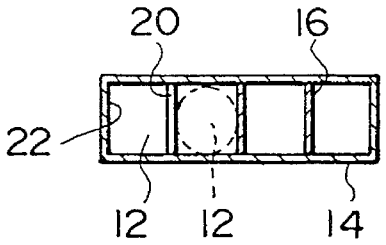
FIG. 2 is a sectional view taken along line 2—2 of FIG. 1.

The first embodiment of a muffler relating to the present invention will be described in detail with reference to FIGS. 1 and 2. As illustrated in FIG. 1, a base end portion, serving as a first offshoot path means or a first portion, of an offshoot path 12 for a side branch is connected to a middle of a ventilation path 10 of intake/exhaust pipes of an internal combustion engine. The remaining portion, serving as a second offshoot path means or a second portion, of the offshoot path 12, i.e., the portion other than the base end portion, is formed within a square, box-shaped chamber 14. As shown in FIG. 2, a partition wall 16 extends between a top wall and a bottom wall of the chamber 14. The offshoot path 12 is bent along the partition wall 16 so as to go around the chamber 14. The end of the offshoot path 12 is closed by the partition wall 16.

The base end portion of the offshoot path 12 between the ventilation path 10 and the chamber 14 is formed within a neck pipe 18 which serves as a communicating pipe and whose cross section is circular. The remaining portion of the offshoot path 12 within the chamber 14 is formed so as to have a square cross section. In FIG. 2, the remaining portion of the offshoot path 12 within the chamber 14 is formed so as to have a square cross section of a size which allows the neck pipe 18 to be inscribed therein. However, the square sectional area of the remaining portion of the offshoot path 12 may be formed so that the sectional area thereof is equal to the sectional area of the circular configuration of the offshoot path 12 within the neck pipe 18. In FIG. 1, the side branch length L, which is shown by the one dot chain line and which has arrows at both ends thereof, is the sum total of the length of the offshoot path 12 within the neck pipe 18 and the length of the offshoot path 12 within the chamber 14.

Cutout portions, or openings 20, are formed in the partition wall 16 in the chamber 14. As shown in FIG. 2, the cutout portions 20 are formed by slit-shaped openings 20 which extend between the upper wall and the lower wall of the chamber 14. The openings 20 are disposed along the offshoot path 12 at predetermined intervals. In the present embodiment, there are five openings 20. As a result of this structure, the offshoot path 12 can communicate, via the openings 20, with the offshoot path 12 which is adjacent thereto and separated therefrom by the partition wall 16 of the chamber 14.

Next, the operation of the present embodiment will be described.

First, sound waves entering the offshoot path 12 within the chamber 14 are propagated along the direction of the offshoot path 12 to the closed end portion thereof.

At the areas of the respective openings 20, the sound waves escape in a direction orthogonal to the direction of the offshoot path 12, and short cuts are generated so that the sound waves spread throughout the entire chamber 14. The offshoot path 12 becomes incomplete due to the openings 20. The offshoot path 12 within the neck pipe 18 is a conducting portion for a resonator. Regardless of the existence of the offshoot path 12, the entire interior of the chamber 14 is a resonance chamber 22 for a resonator. Accordingly, not only a side branch type silencing function, but also a resonator type silencing function is exhibited.

The configuration of the present apparatus and the configuration of the offshoot path 12, for example, the length L of the offshoot path 12, the sectional area thereof and the like, are set according to the frequencies of the sound waves to be damped.

When the openings 20 are small enough, the present apparatus functions as a side branch type muffler and has the following resonance frequency:

$$f_n=[(2n-1)/4]\times c/L_1 (n=1, 2, 3 \ldots) \quad (1)$$

wherein c is the acoustic velocity and $L_1$ is the length of the side branch after correction.

When the openings 20 are large enough, i. e., when there is no partition wall 16 within the chamber 14, the present apparatus functions as a resonator type muffler and has the following resonance frequency:

$$f_0=(c/2\pi)\times[\sqrt{(S/L_2V)}] \quad (2)$$

wherein S is the sectional area of the communicating pipe, $L_2$ is the length of the communicating pipe after correction, V is the volume, and c is the acoustic velocity.

Accordingly, with the above in view, the configuration of the offshoot path 12 is set along with the setting of the size and number of the openings 20.

Figure 9:
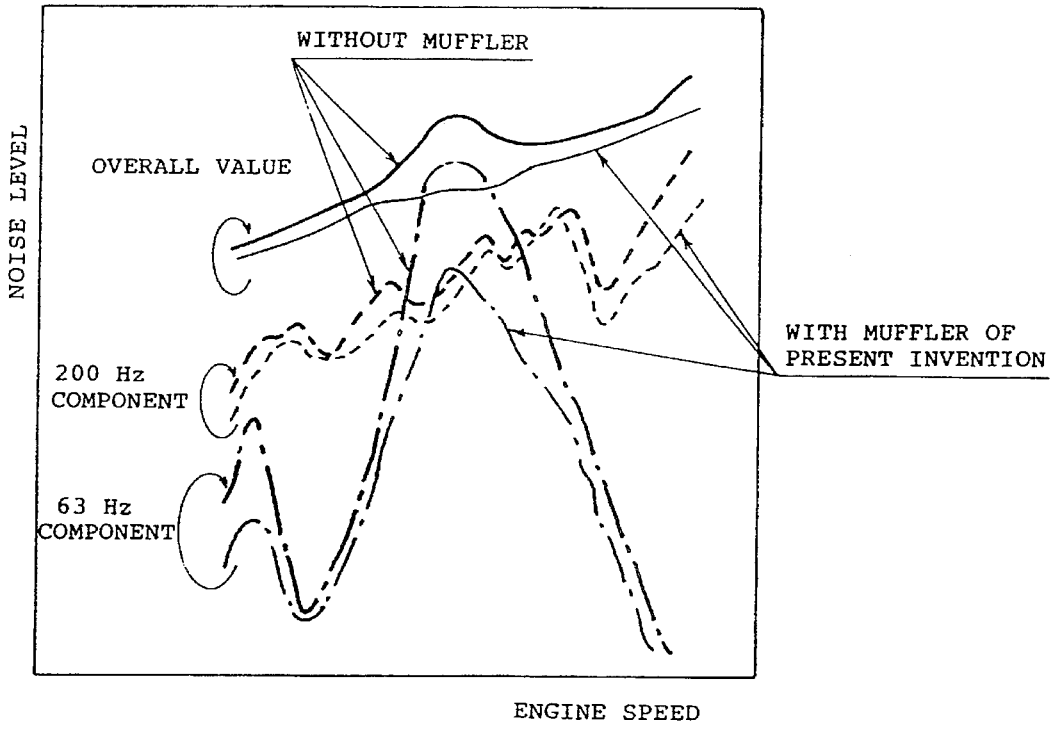
FIG. 9 is a graph showing experimental results of an embodiment.

For example, when a side branch type muffler whose resonance frequency is 63 Hz and a resonator type muffler whose resonance frequency is 200 Hz are combined, as shown by the experimental results given in FIG. 9, although the volume of the muffler of the present embodiment is small, the overall value of the suction sound is effectively decreased.

In this way, with only the volume that the offshoot path 12 for a side branch occupies, the side branch type muffler capacity is combined with the resonator type muffler capacity which has a different resonance frequency. Therefore, sound waves over a wide range of frequencies are damped while only a small mounting space for the muffler is needed.

Figure 3:
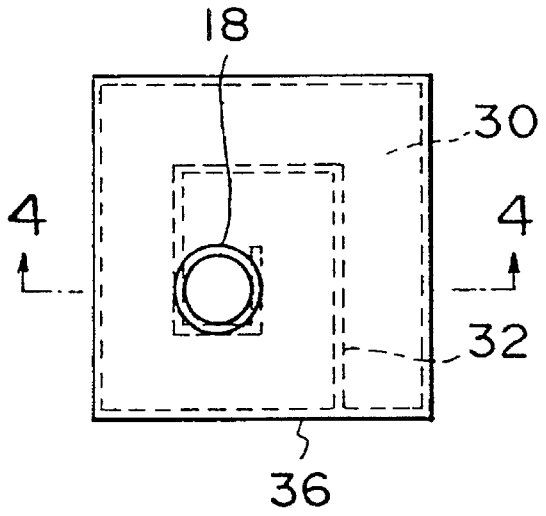
FIG. 3 is a plan view illustrating a variation of the first embodiment.
Figure 4:
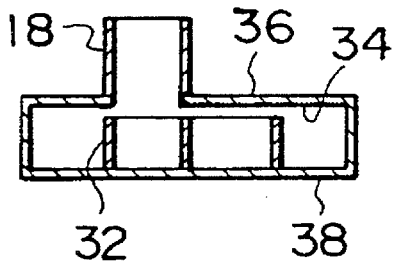
FIG. 4 is a sectional view taken along line 4—4 of FIG. 3.

Further, in the present embodiment, the cutout portions are formed by a plurality of openings 20. However, as shown in a variation in FIGS. 3 and 4, a continuous partition wall 32, which runs along the offshoot path 30, protrudes from the bottom wall towards the top wall of a square, box-shaped chamber 36 shown in FIG. 4. A gap is formed between the top protruding edge and the top wall. In this way, an opening portion is formed as a continuous gap form which runs along the partition wall 32. In the present variation, the neck pipe 18 is directed orthogonally with respect to the offshoot path 30 within the chamber 36.

Figure 5:
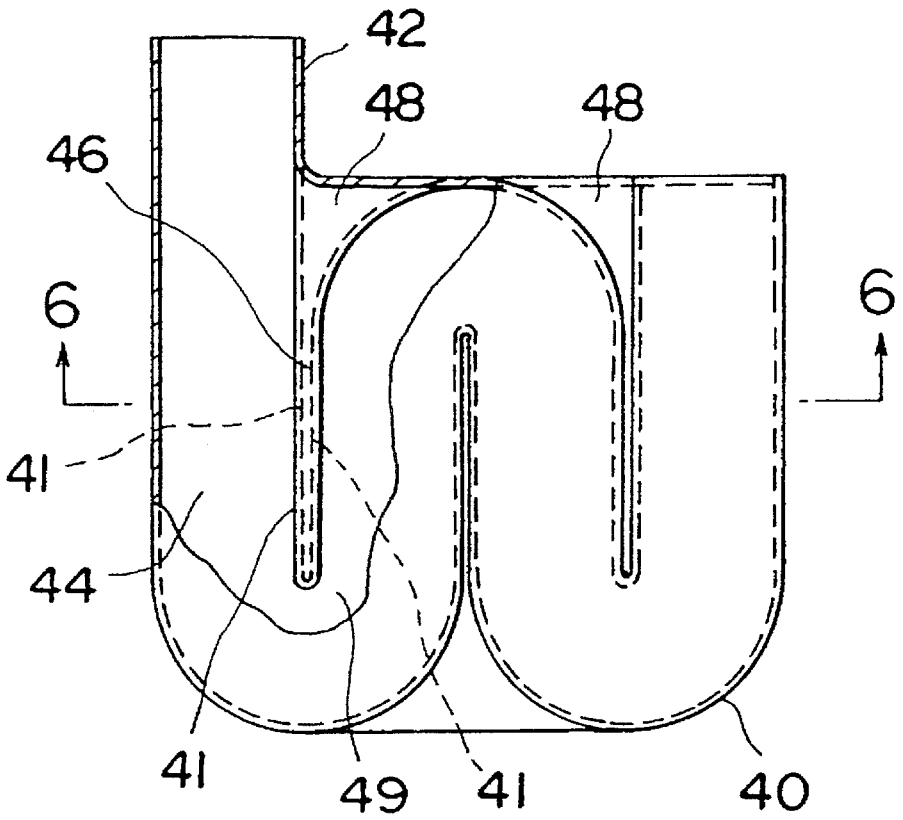
FIG. 5 is a vertical sectional view of main portions of second embodiment.
Figure 6:
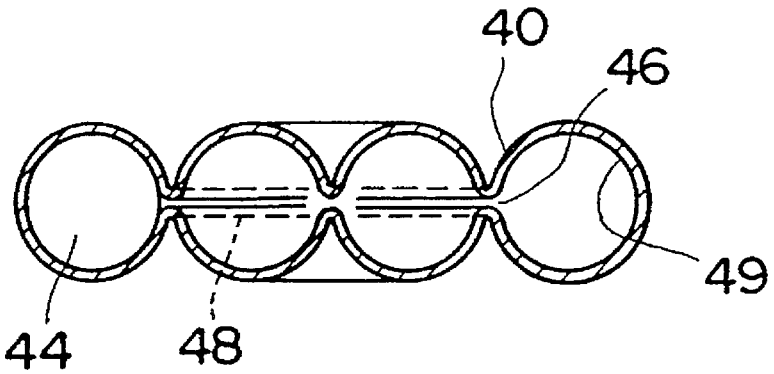
FIG. 6 is a sectional view taken along line 6—6 of FIG. 5.

Next, a second embodiment will be described with reference to FIGS. 5 and 6.

In the second embodiment, a chamber 40 is formed integrally with a neck pipe 42 by blow molding. An offshoot path 44 is formed with a circular cross section within the chamber 40, and is formed so that the longitudinal direction of the offshoot path 44 is a substantial W-shape. Further, at areas at which outer walls of the chamber 40, which form the offshoot path 44, also serve as partition walls 41 in the vertical direction in FIG. 5, openings 46, which are formed as slit-shapes which extend vertically in FIG. 5, are formed so as to pass within reinforcing portions 48 which reinforcingly connect the above-described areas so that the outer walls of the chamber 40 at these areas communicate with the adjoining offshoot path 44.

In this way as well, a resonating chamber 49 for a side branch is formed within the chamber 40, and operational effects similar to those of the first embodiment are achieved. In addition, the apparatus is formed integrally so that production thereof is facilitated.

Figure 7:
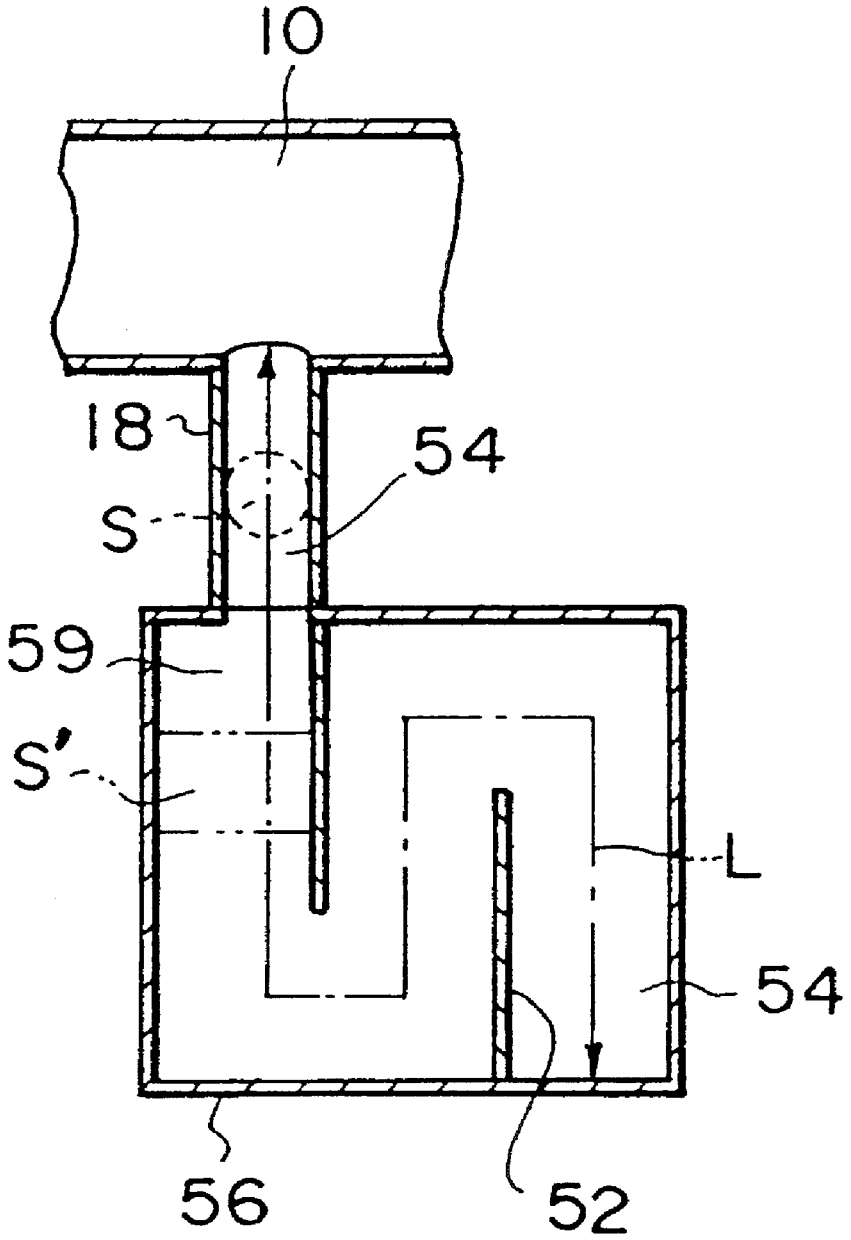
FIG. 7 is a vertical sectional view illustrating a third embodiment.

Next, a third embodiment will be described with reference to FIG. 7.

In the third embodiment, an opening is not formed in a partition wall 52 within the chamber 56. A sectional area S' of a offshoot path 54 within the chamber 56 is larger than a sectional area S of the offshoot path 54 at the neck pipe 18, i.e., S<S'. In FIG. 7, the sectional area S is shown by the broken line, and the sectional area S' is shown by the two-dot chain line. Portions having sectional areas S, S' are respectively a cross-sectional configuration of the offshoot path 54 at the neck pipe 18 and a cross-sectional configuration of the offshoot path 54 within the chamber 56. Further, the sectional areas S, S' illustrate areas of surfaces orthogonal to the direction in which the offshoot path 54 extends.

According to the above-described structure, when sound waves entering the offshoot path 54 within the chamber 56 are propagated along the direction of the offshoot path 54 to the closed end portion thereof, the sound waves spread, within the offshoot path 54 within the chamber 56, in a direction orthogonal to the direction of the offshoot path 54. The offshoot path 54 within the neck portion 18 is a conducting portion for a resonator. The offshoot path 54 within the chamber 56 is a resonance chamber for a resonator. Accordingly, not only a side branch type silencing function, but also a resonator type silencing function is exhibited.

Namely, when S≈S', there is side branch type silencing. When S<<S', there is resonator type silencing. Accordingly, even if an opening is not formed, by setting S/S' to an appropriate value, both functions of a side branch type muffler and a resonator type muffler are exhibited, based on the formulae [(1) and (2)] for calculating resonance frequencies for the above-described side branch type silencing and resonator type silencing.

Further, by making the sectional area of the offshoot path 54 within the chamber 56 larger than the sectional area of the offshoot path 54 within the neck portion 18, the volume of the entire apparatus is increased only by that much. Compared to a case in which a side branch type muffler and a resonator type muffler are provided separately for one ventilation path, the increased volume of the apparatus of the present embodiment requires considerably less space.

In addition, because there are no openings, the structure is simplified.

Figure 8:
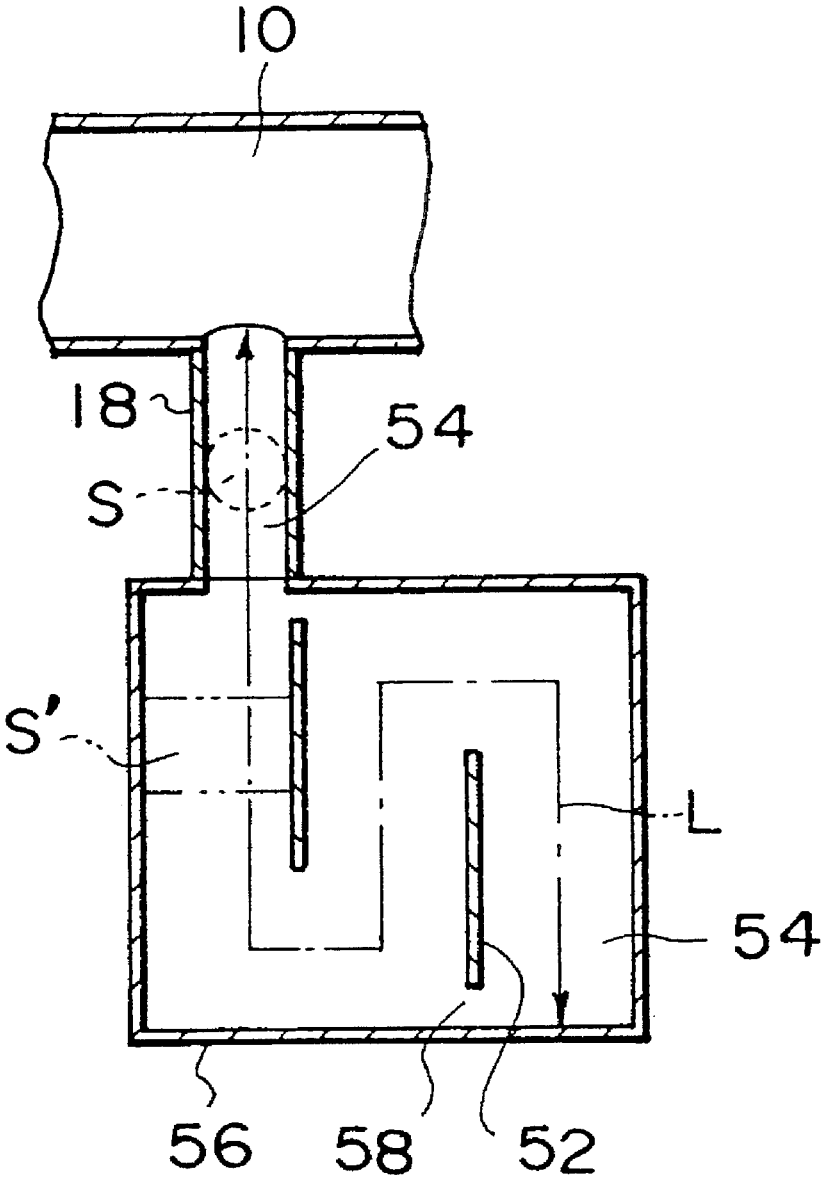
FIG. 8 is a vertical sectional view illustrating a variation of the third embodiment.

Further, as shown in the variation in FIG. 8, opening portions 58 may be provided such as in the first embodiment. In this case as well, the operational effects of the above-described first and third embodiments can be achieved.

Figure 10:
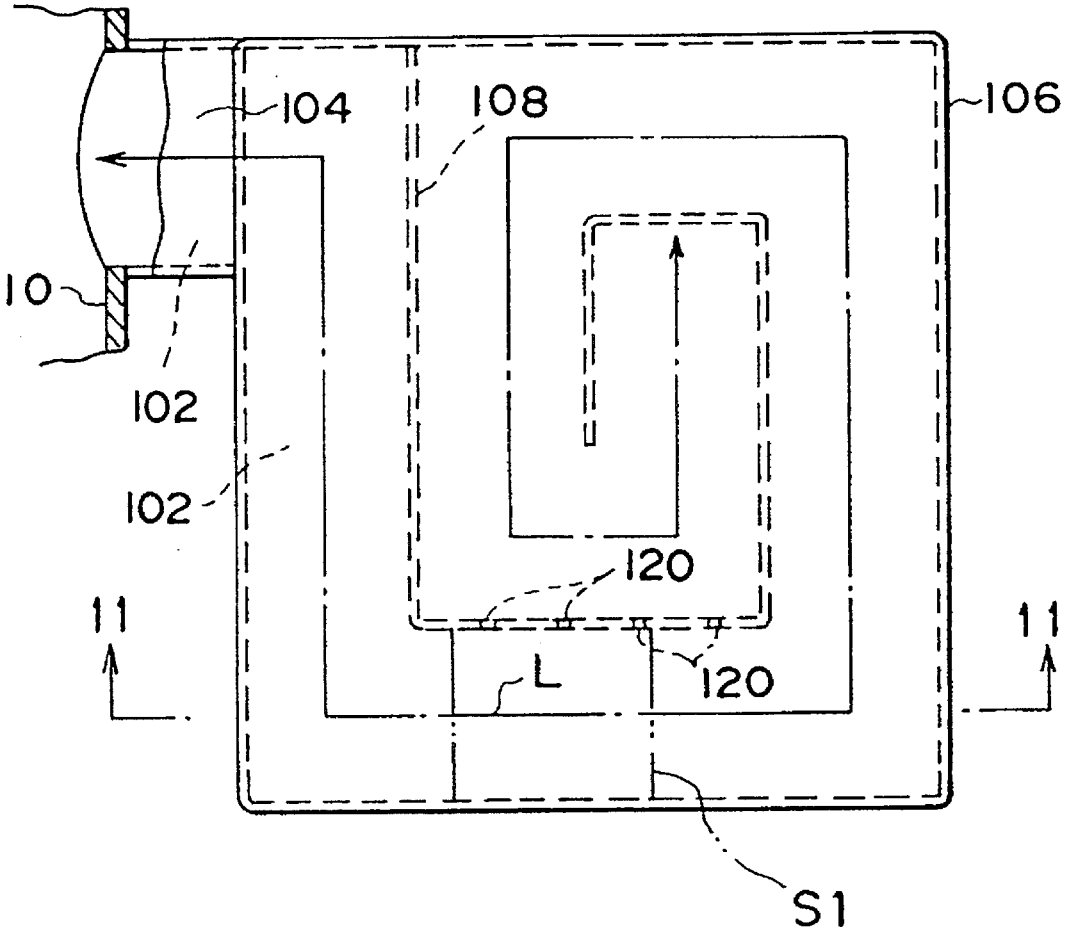
FIG. 10 is a vertical sectional view illustrating a fourth embodiment.
Figure 11:
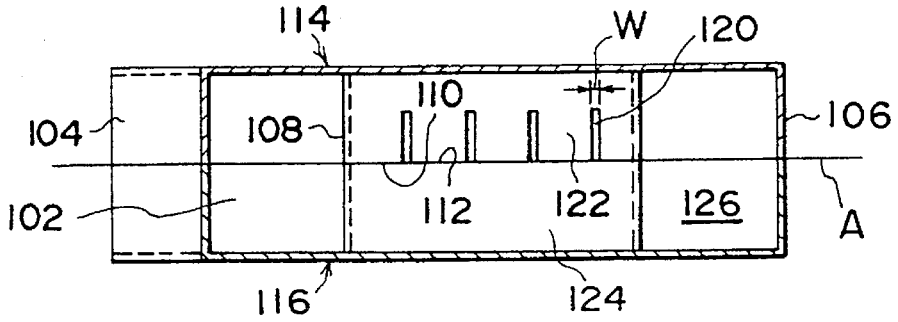
FIG. 11 is a sectional view taken along line 11—11 of FIG. 10.

Next, a fourth embodiment will be described with reference to FIGS. 10 and 11.

in the fourth embodiment, a base end portion of an offshoot path 102 for a side branch is formed within a neck pipe 104 which serves as a communicating pipe and which has a square cross section. A corner portion of a square, box-shaped chamber 106 is connected to the neck pipe 104. Within the chamber 106, the remaining portion of the offshoot path 102 is bent by partition wall 108 provided within the chamber 106. More specifically, as shown in FIG. 10, the offshoot path 102 for a side branch extends from the neck pipe 104 so as to coil within the chamber 106 in a square towards the center in the counterclockwise direction as seen from a direction vertical to the surface of the paper of FIG. 10. The end of the offshoot path 102 for a side branch is closed at a substantial center of the chamber 106.

The above-described chamber 106, including the neck pipe 104, is formed with two members 114, 116 having configurations divided along line A so as to have substantially the same width in the direction orthogonal line A. That is to say, each of the members 114, 116 comprises a half portion of the neck pipe 104 and a half portion of the partition wall 108. The respective members 114, 116 are formed by injection molding of synthetic resin. Respective opposing edges of the members 114, 116 are confronting edges 110, 112 which face each other along the end from the base end of the offshoot path 102 for a side branch. The chamber 106, the neck pipe 104 and the partition wall 108 are formed by the confronting edges 110, 112 being set opposed to each other and being subjected to melt adhesion.

Slit holes 120, which form cutout portions, are formed in a partition wall portion 122 of the member 114. The longitudinal direction of the slit holes 120 is the direction orthogonal to the direction in which the offshoot path 102 for a side branch extends, or the direction in which the members 114, 116 face each other (the direction orthogonal to line A). Ones of ends of the slit holes 120 are open at the confronting edge 110 of the partition wall portion 122. Others of ends of the slit holes 120 terminate at the substantial center of the partition wall portion 122 in the direction orthogonal to line A. (In FIG. 11, four slit holes 120 are disposed so as to be parallel to each other and spaced at predetermined intervals).

In the present embodiment, as in the first embodiment, the offshoot path 102 is incomplete due to the slit holes 120. The offshoot path 102 within the neck pipe 104 is a conducting portion for a resonator. Regardless of the existence of the offshoot path 102, the entire interior of the chamber 106 is a resonating chamber 126 for a resonator. In the present embodiment, not only is a side branch type silencing function exhibited, but a resonator type silencing function is exhibited as well.

Further, if the sectional area of the offshoot path 102 within the chamber 106 is larger than the sectional area of the offshoot path 102 at the neck pipe 104, the operational effects described in the explanation of the third embodiment are achieved in the present embodiment as well.

Moreover, if the proportion of the area occupied by the open end of the slit hole 120 with respect to the entire area of the slit hole 120 is small and the width W of the slit is a precise dimension, excessive dimensional accuracy of the dimension of the member 114 in the confronting direction (the longitudinal direction of the slit hole 120) is not required in the production of the member 114 in which the slit hole 120 is formed, in the production of the other member 116, or in the opposing of the members 114, 116 during assembly thereof. The predetermined dimensional configuration of the slit hole 120 is easily obtained, and the precision of the areas of the openings improves.

In this way, the ratio of the areas of the openings with respect to the sectional area (the two-dot chain line S1 shown in FIG. 10) of the offshoot path 102 for a side branch within the chamber 106 is obtained with high precision. Tuning with respect to frequencies of sounds for which damping is desired can be effected easily and precisely.

Figure 12:
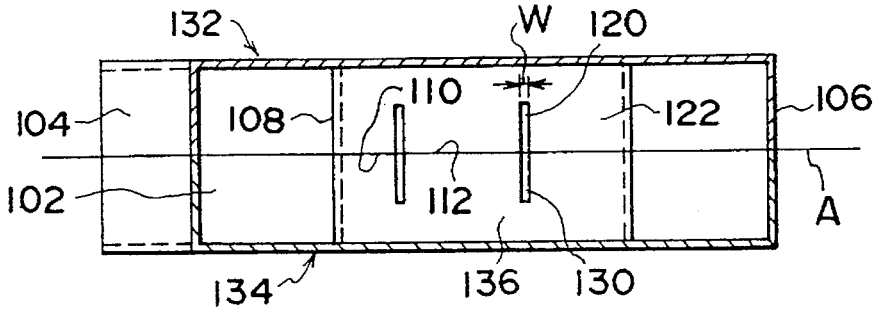
FIG. 12 is a view corresponding to FIG. 11 and illustrating a variation of the fourth embodiment.
Figure 13:
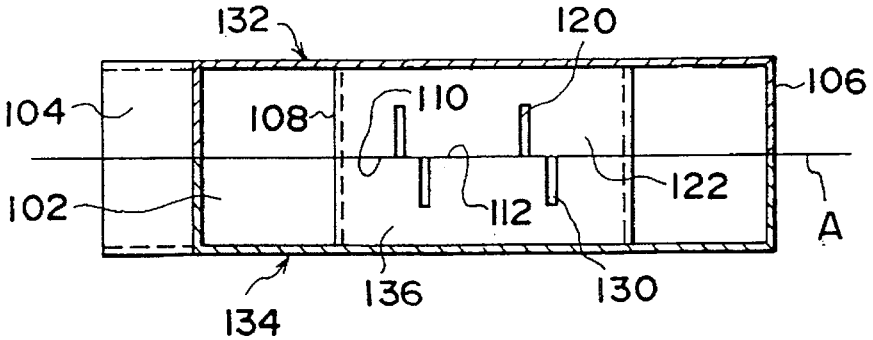
FIG. 13 is a view corresponding to FIG. 11 and illustrating another variation of the fourth embodiment.
Figure 14:
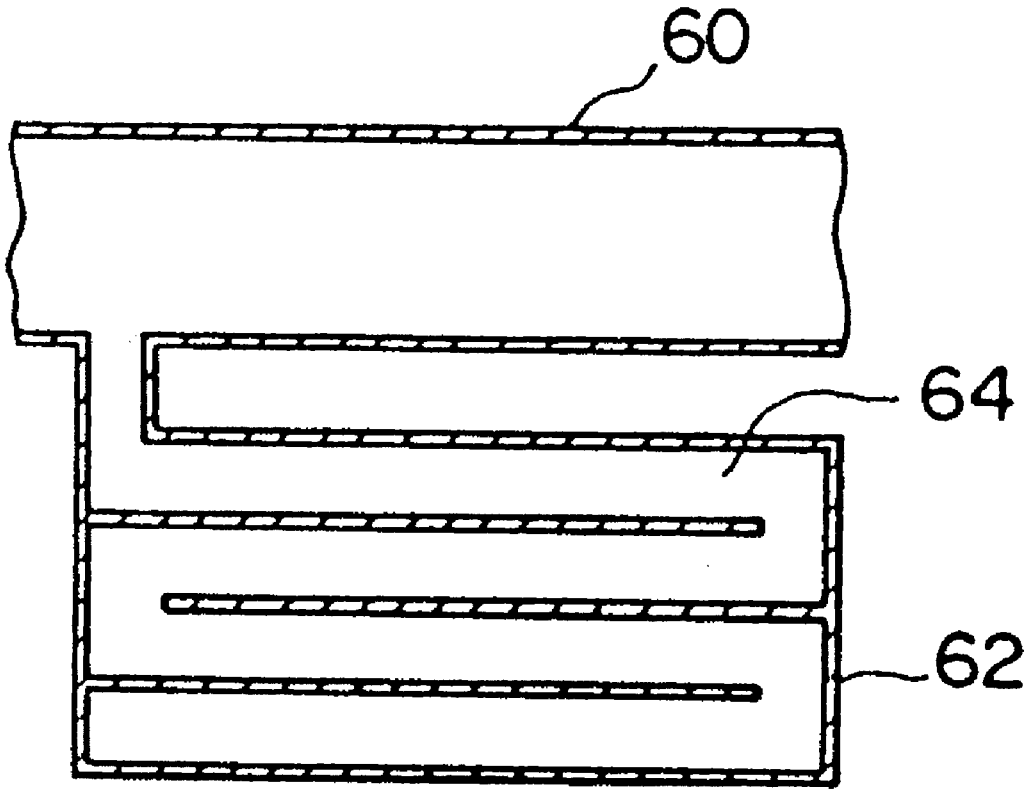
FIG. 14 PRIOR ART
FIG. 14 is a vertical sectional view illustrating a conventional muffler.

As shown in respective variations in FIGS. 12 and 13, in addition to slit holes 120 being formed in the partition wall portion 122 of one member 132, it is possible to form slit holes 130 in a partition wall portion 136 of another member 134 as well. In this case, as shown in FIG. 12, the open ends of the slit holes 120 of the partition wall portion 122 of the member 132 and the open ends of the slit holes 130 of the partition wall portion 136 of the other member 134 may correspond to each other. Alternatively, as shown in FIG. 13, a structure in which the respective open ends of the slit holes 120, 130 do not correspond to each other is also possible.

Either of these cases results in operational effects similar to those which result from forming the slit holes 120 only in the partition wall portion 122 of one member 132.

Further, in the fourth embodiment and respective variations thereof, the slit holes 120, 130 are formed such that the longitudinal directions thereof are a direction orthogonal to the direction in which the offshoot path 102 extends, i.e., the longitudinal directions of the slit holes 120, 130 are the direction orthogonal to line A. However, the fourth embodiment and variations thereof are not limited to the same. The slit holes 120, 130 may be formed in directions inclined with respect to a line orthogonal to line A or may be formed as curves. It suffices that ones of ends of the slit holes 120, 130 be open at the confronting edges 110, 112, and that the other ends be closed.

Moreover, in the fourth embodiment and the respective variations thereof, the members 114, 116, 132, 134 are formed so as to divide each of the neck pipe 104, the partition wall 108, and the chamber 106 respectively into two portions having the same width in the direction of line A. However, the fourth embodiment and variations thereof are not limited to the same. It suffices that there are, at least, a wall to partition the chamber in the direction of line A and members to divide the chamber in the direction of line A. Further, the number of the slits 120, 130, the intervals at which they are provided, and the configurations thereof are not limited to those of the embodiment, but are set so that the side branch type silencing capacity and the resonator type silencing capacity can be exhibited to the maximum.

The present invention has been described by various embodiments and variations thereof. However, the present invention is not limited to the aforementioned embodiments and variations, and various changes are possible.

As described above, in the muffler relating to the present invention, the function of a side branch type muffler and the function of a resonator type muffler are both exhibited by one muffler. Therefore, sounds of a plurality of frequency ranges can be damped by one muffler. Further, the muffler of the present invention functions well while occupying a volume which is necessary for a side branch type muffler to deaden sound. Therefore, compared with other hybrid type mufflers, the muffler of the present invention is more compact and can be installed in a small space. The ability to the muffler of the present invention into an internal combustion engine also improves.

Further, compared with conventional cases in which a plurality of mufflers are provided separately, the number of mufflers which are mounted to an internal combustion engine or the like can be reduced by the use of the muffler of the present invention. The number of parts can thereby be decreased, and the ease of assembly of the muffler can be improved.

Compared with other hybrid mufflers, manufacture of the muffler of the present invention is simple. Production of the muffler itself is facilitated, and its produceability is excellent.

What is claimed is:

1. A muffler for connection to an intermediate portion of a ventilation conduit comprising:

means for defining an offshoot path including:

an offshoot path member having a first opening and a second opening, said first opening designed to be connected to said intermediate portion of said ventilation conduit; and an enclosed chamber connected to and in communication with said offshoot path member at said second opening, said enclosed chamber containing at least one partition positioned therein such that said offshoot path undergoes at least one bend in direction within said chamber, and at least one small opening in said at least one partition, said at least one small opening positioned transversely to said offshoot path.

2. A muffler according to claim 1, having a cross-sectional area in said offshoot path member and wherein said offshoot path has a cross-sectional area in said enclosed chamber which is greater than said cross-sectional area in said offshoot path member.

3. A muffler according to claim 1, wherein said at least one small opening is a plurality of small openings formed in said at least one partition and positioned transversely to said offshoot path, and wherein said at least one bend in direction provides multiple directions for said offshoot path, said plurality of small openings providing communication between said multiple directions of said offshoot path.

4. A muffler according to claim 3, wherein said at least one bend in direction of said offshoot path comprises a plurality of bends in direction and wherein said at least one partition is of a predetermined shape that extends in a plurality of directions within said enclosed chamber to cause said offshoot path to undergo said plurality of bends in direction within said chamber, and wherein said plurality of small openings are positioned in said at least one partition along said plurality of directions of said at least one partition.

5. A muffler according to claim 1, wherein said enclosed chamber comprises an outer shell having an interior partitioned by said at least one partition.

6. A muffler according to claim 1, wherein said direction of said offshoot path is longitudinal and said at least one small opening in said at least one partition is formed in the shape of an elongated slit extending transverse to said longitudinal direction of said offshoot path.

7. A muffler according to claim 1, wherein said ventilation conduit is in communication with said offshoot path via said offshoot path member, said enclosed chamber, and said first and second openings to allow sound waves to enter into said offshoot path member from said ventilation conduit and to allow said sound waves to propagate into said enclosed chamber through said offshoot path and said at least one small opening, said sound waves being damped thereby.

8. A muffler according to claim 1, wherein said at least one partition comprises a plurality of partitions positioned in said enclosed chamber, and wherein said at least one bend in direction of said offshoot path comprises a plurality of bends in direction, said plurality of partitions causing said offshoot path to undergo said plurality of bends in direction within said enclosed chamber, whereby said offshoot path comprises offshoot path portions formed by said plurality of bends in direction of said offshoot path, and wherein said at least one small opening comprises a plurality of small openings formed in said plurality of partitions to provide communication between said offshoot path portions.

9. A muffler for connection to an opening in a ventilation path, comprising:

an offshoot path member defining an offshoot path and having a first opening and a second opening, said first opening designed to be connected to said opening of said ventilation path;

a bent path member defining a bent path and including an enclosed chamber having an opening, said opening being connected to said second opening of said offshoot path member, and a plurality of partitions being disposed within said enclosed chamber to provide a plurality of bends for said bent path, said bent path comprising adjacent portions separated by said plurality of partitions;

said plurality of partitions having at least one small opening along said bent path to provide communication between said adjacent portions of said bent path.

10. A muffler according to claim 9, wherein each of said bent path and said offshoot path has a cross-sectional area, and said cross-sectional area of said bent path is greater than said cross-sectional area of said offshoot path.

11. A muffler according to claim 9, further comprising an outer shell in which said enclosed chamber is defined.

12. A muffler according to claim 11, wherein said adjacent portions extend in longitudinal directions and said at least one small opening in said plurality of partitions is formed in the shape of an elongated slit extending transverse to said longitudinal directions of said adjacent portions.

13. A muffler according to claim 11, wherein said at least one small opening is a plurality of small openings in said plurality of partitions, said plurality of small openings being spaced apart along said bent path.

14. A muffler according to claim 11, further comprising a gap between at least one of said plurality of partitions and said outer shell, said gap being provided along said bent path.

15. A muffler according to claim 9, wherein said offshoot path member and said bent path member are integrally constructed of complementary lower and upper sections joined together, said plurality of partitions comprised of aligned partition portions in respective ones of said complementary upper and lower sections to form said plurality of partitions in said joined together complementary lower and upper sections.

16. A muffler according to claim 15, wherein said at least one small opening in said plurality of partitions is provided in at least one of said aligned partition portions in said joined together complementary upper and lower sections.

17. A muffler according to claim 15, wherein said at least one small opening in said plurality of partitions is formed in said aligned partition portions as aligned slit portions to form at least one elongated slit in said plurality of partitions in said joined together complementary lower and upper sections.

18. A muffler according to claim 9, wherein said ventilation path communicates with said bent path, via said offshoot path member, said bent path member and said first and second openings to allow sound waves to enter into said offshoot path member from said ventilation conduit and to allow said sound waves to propagate into said bent path member through said bent path and said at least one small opening, said sound waves being damped thereby.

19. A muffler for connection to a ventilation conduit comprising:

an offshoot path member having a first opening and a second opening, said first opening designed to be connected to said ventilation conduit;

an enclosed chamber including top and bottom walls and first and second side walls, said enclosed chamber connected to and in communication with said offshoot path member at said second opening, said enclosed chamber including at least one interior partition extending from one of said first and second side walls toward the other of said first and second side walls but not contacting the other of said first and second side walls, said at least one interior partition also extending from one of said top and bottom walls toward but not contacting the other of said top and bottom walls to form an open end of said at least one interior partition, and a continuous gap between said open end of said at least one interior partition and the other of said top and bottom walls; and said offshoot path member, said enclosed chamber, and said at least one interior partition defining an offshoot path, and said continuous gap providing an escape path for sound waves in said offshoot path.

20. A muffler as claimed in claim 19, wherein said at least one interior partition includes more than one interior partition.

* * * * *